US006830030B2

(12) United States Patent
Imafuku et al.

(10) Patent No.: US 6,830,030 B2
(45) Date of Patent: Dec. 14, 2004

(54) FOUR-CYCLE ENGINE

(75) Inventors: Kenji Imafuku, Hiroshima (JP); Masaharu Shimoji, Hiroshima (JP); Junichi Ueda, Hiroshima (JP); Hidenori Hiraki, Hiroshima (JP)

(73) Assignee: Shindaiwa Kogyo Co., Ltd. (JP)

( * ) Notice: Subject to any disclaimer, the term of this patent is extended or adjusted under 35 U.S.C. 154(b) by 38 days.

(21) Appl. No.: 10/214,823

(22) Filed: Aug. 7, 2002

(65) Prior Publication Data

US 2003/0037763 A1 Feb. 27, 2003

(30) Foreign Application Priority Data

Aug. 7, 2001 (JP) ..... 2001-239112

(51) Int. Cl.[7] ..... F02B 75/02
(52) U.S. Cl. ..... 123/318; 123/317; 123/196 R
(58) Field of Search ..... 123/318, 317, 123/196 CP, 196 R, 73 AD

(56) References Cited

U.S. PATENT DOCUMENTS 4,558,671 A * 12/1985 Stinebaugh ..... 123/317
4,708,107 A * 11/1987 Stinebaugh ..... 123/317
5,230,314 A * 7/1993 Kawahara et al. ..... 123/318
6,055,959 A * 5/2000 Taue ..... 123/318
6,145,484 A * 11/2000 Funakoshi et al. .... 123/196 CP

* cited by examiner

*Primary Examiner*—Henry C. Yuen
*Assistant Examiner*—Jason Benton
(74) *Attorney, Agent, or Firm*—Schwabe, Williamson & Wyatt, P.C.

(57) ABSTRACT

A four-cycle engine wherein a fuel-air-oil mixture is compressed in a crank case chamber and directed therefrom along a pathway to a combustion chamber. The pathway contains actuating mechanism for actuating the fuel intake valve leading to the combustion chamber. The pathway is restricted in volume as permitted by the actuating mechanism, preferable to a range of two to four times the piston displacement.

5 Claims, 4 Drawing Sheets

FOUR-CYCLE ENGINE

Priority is claimed under 35 USC §119(a) based on Japanese Patent Application Serial No. 2001-239112 filed Aug. 7, 2001.

FIELD OF INVENTION

This invention relates to engines typically used for powered outdoor tools and particularly to such engines which are fueled with a gas lubricant mixture.

BACKGROUND OF THE INVENTION

It is considered desirable to use four-cycle engine technology over two-cycle engine technology, e.g., for powered outdoor hand tools as both noise and emissions are reduced. A typical four-cycle engine is fueled by a vaporized gasoline and air mixture and a gas flow path leads directly from the engine's carburetor to the engine's combustion chamber. Such engines provide oil reservoirs that provide the lubricants necessary for lubricating the moving components of the engine. Small engine use typically does not adapt to this form of lubrication. Small engines used for, e.g., portable powered outdoor tools like hedge trimmers and the like are used in a manner where the engine is turned sideways and even upside down during operation and the oil reservoir type of lubrication is not practical.

Accordingly, four-cycle engines have been developed that are fueled by a gas/oil mixture. (See U.S. Pat. No. 4,708,107). The path of the gas-oil flow is arranged so as to flow in and around the moving components and oil from the mixture is deposited on the components to provide the desired lubrication.

Whereas the use of the lubricant bearing fuel provides the desired result, i.e., lubrication of the parts while using four-cycle technology, and thus less noise and emissions pollution, there are problems as compared to prior two-cycle engines.

One problem is in starting the engines, e.g., with a recoil or starter rope (typical for small engine starting). The path of the fuel is substantially extended over a traditional four-cycle engine design and thus the volume of fuel that has to be pumped through the extended passage requires repeated pulls of the starter rope. Further, in the startup mode, because the flow of fuel initially moves slowly through the extended pathway and the lubricant readily collects on the components, following startup and more rapid flow of the fuel, much of the deposited oil re-enters the flow of fuel and the desired ratio of fuel to oil is altered resulting in incomplete combustion. A still further problem addressed by the present engine design is the desire to limit the engine's speed (revolutions per minute) when the engine is not under load.

BRIEF SUMMARY OF THE INVENTION

The present design reduces the volume of the extended fuel flow passage and thus the fuel that has to be pumped to achieve startup is reduced. The preferred embodiment of the invention provides valve actuating mechanism including a timing gear interconnected to a cam gear from which a cam lifter actuates a push rod and rocker arm, which in combination, controls the engine's intake and exhaust valves. The arrangement of these components also determines the flow path of the fuel. By strategic use of the periphery of the timing gear and cam gear, the rotation of these gears assists in boosting the fuel flow along the pathway. Also by maintaining a close tolerance around the working components the path is reduced in volume and requires less fuel to fill that volume. Such strategic use of the components and the tightening of the tolerances enables an engine design that provides a volume for the flow path of the fuel that can be matched to the displacement of the piston in a ratio of between two and four-to-one. This has been found to achieve the desired improvement in flow rate to improve both startup and initial idling of the engine without detrimental affect on the thereafter running of the engine.

Overrunning of the engine is also a consideration herein and is controlled at least in part by reducing the size of the fuel intake port entering the combustion chamber, e.g., to a size less than the air intake port entering the carburetor.

The above and further improvements will be more fully appreciated upon reference to the following detailed description and drawings referred to therein.

DETAILED DESCRIPTION OF THE PREFERRED EMBODIMENT

Figure 2:
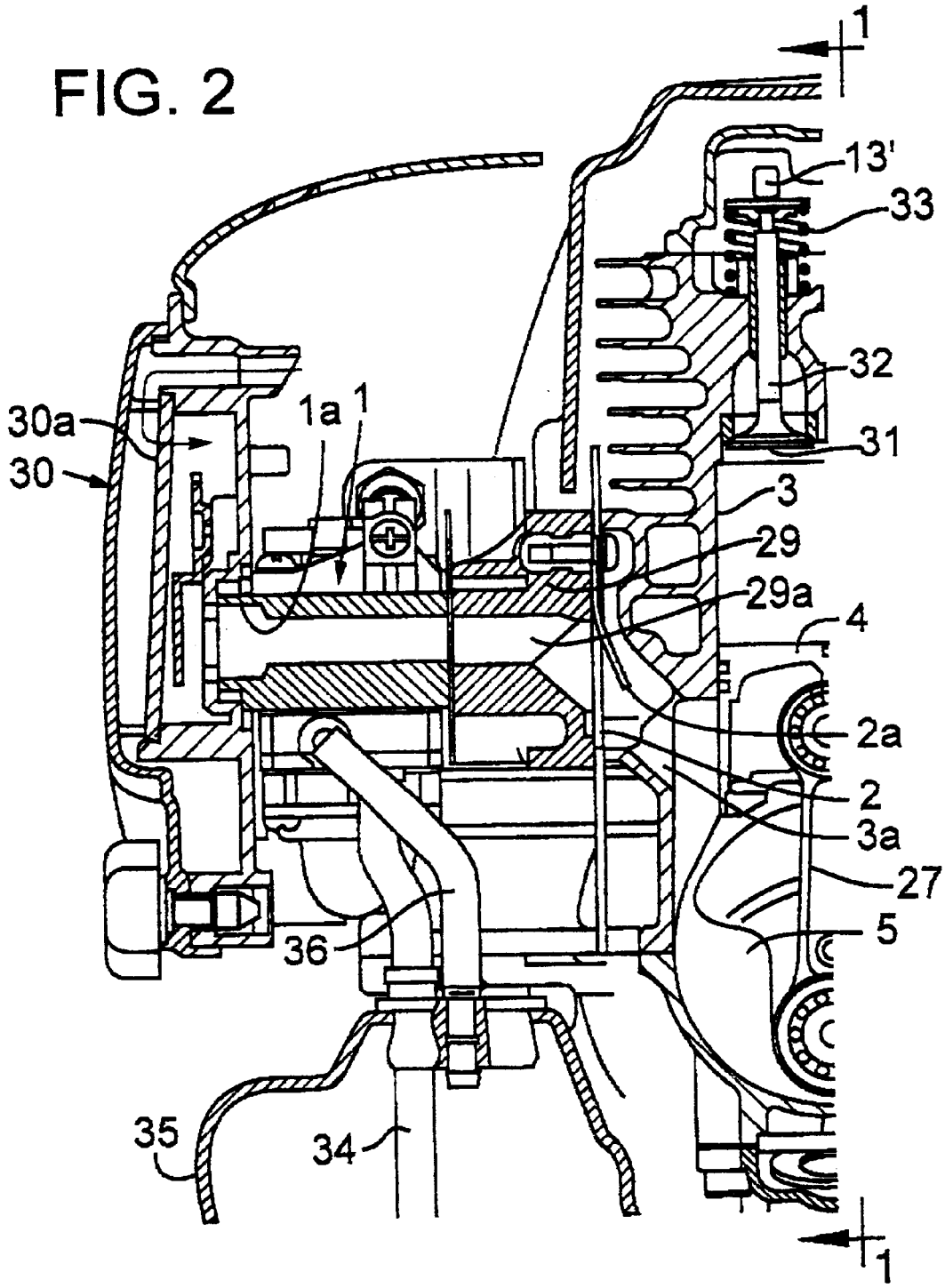
FIG. 2 is a sectional view of the embodiment of FIG. 1 illustrating the air filter and source of fuel mixture which is converted to a vaporized form in a carburetor and including the flow path to a crank case chamber.

Reference is first made to FIG. 2 which illustrates a fuel source 35 containing a mixture, e.g., of gasoline and oil, including a fuel supply pipe 34 and a fuel return pipe 36. Fuel from the fuel source 35 is directed to a carburetor 1 via the supply pipe 34 and air is directed to the carburetor from air cleaner 30, through filter 30*a* and into the carburetor air intake port 1*a*. The fuel and air are converted to a vapor having oil droplets that is then directed through passage 29*a* through an insulating member 29 and, as permitted by valve cover 2*a*, through check valve 6 and into a crank case chamber 5 (the fuel being passed through inner wall face 3*a*).

The pathway for directing the fuel from the crank case chamber 5 to the combustion chamber 21 will be later described in connection with FIGS. 1, 3 and 4. From FIG. 2 it will be appreciated that the fuel from the carburetor is drawn into the crank case chamber 5 as the piston 4 is moved upwardly in the cylinder 3, which increases the volume of the crank case chamber 5. As the volume is increased, a suction (negative pressure) occurs which pulls check valve 2 open and draws the fuel-air mixture (in vapor form) into the crank case chamber. In the downward stroke of piston 4, the volume in chamber 5 is decreased to produce a positive pressure that closes check valve 2 and prevents return flow of the fuel. The fuel within chamber 5 is thereby compressed.

Figure 1:
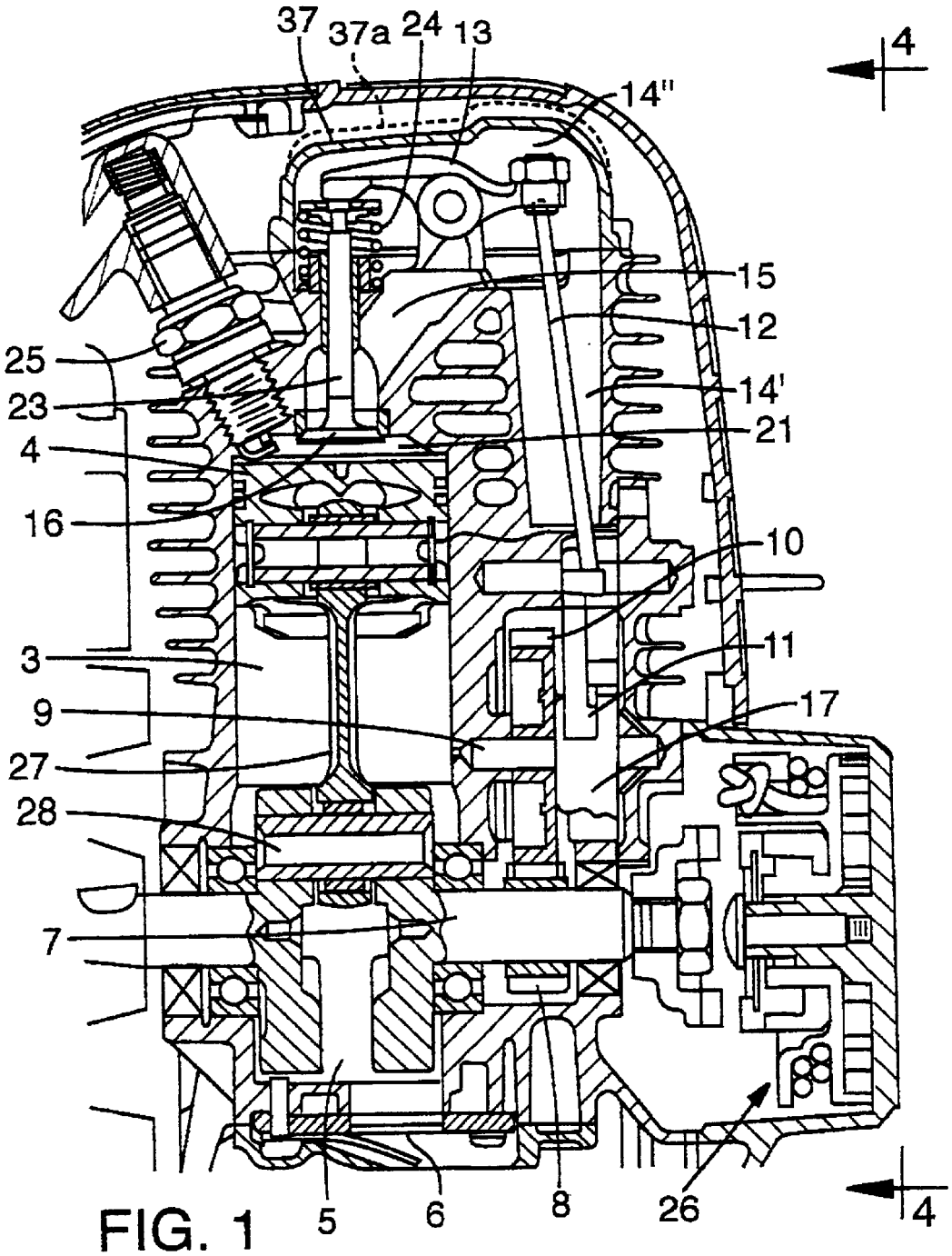
FIG. 1 is a sectional view of an embodiment of the invention illustrating the arrangement of components and fuel mix flow path from the crank case chamber to the combustion chamber.

Reference is now made to FIG. 1 which is a view generally from the direction of view lines 1—1 of FIG. 2. Within chamber 5 is the crank case shaft 7 which defines a center of rotation for crank pin 28 which carries connecting rod 27 which connects the piston 4 to the crank pin 28. As the piston reciprocates up and down the crank shaft 7 is rotated.

As previously explained, the downward movement of the piston produces compression of the fuel in chamber 5 and this compression opens check valve 6 allowing fuel to flow from the chamber and into a flow path that extends to the combustion chamber 21 as will now be described.

Figure 3:
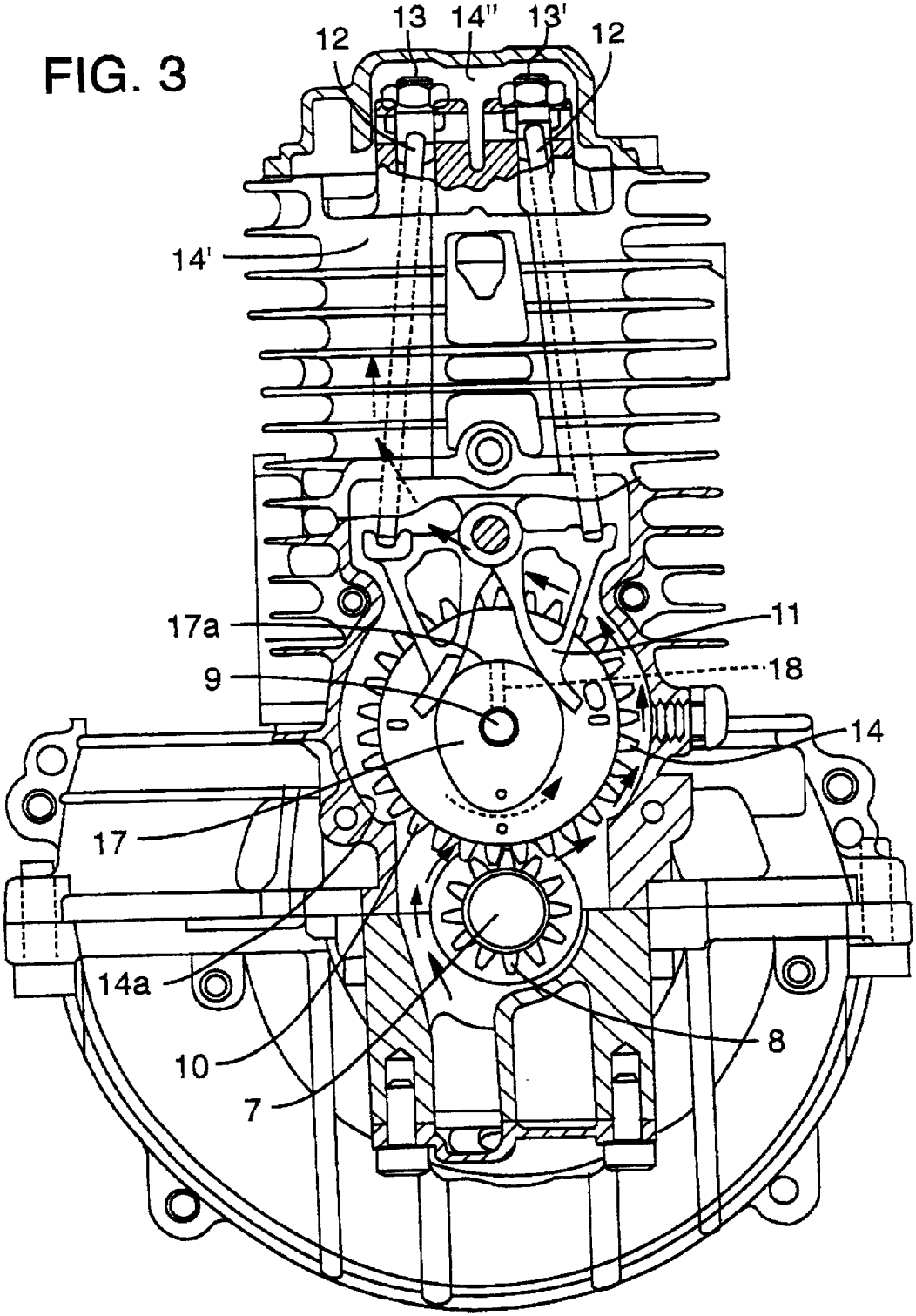
FIGS. 3 and 4 are diagrammatic illustrations of the flow path for the fuel as between the crank case chamber and the combustion chamber from a viewpoint generally indicated by directional arrows 4—4 of FIG. 1.
Figure 4:
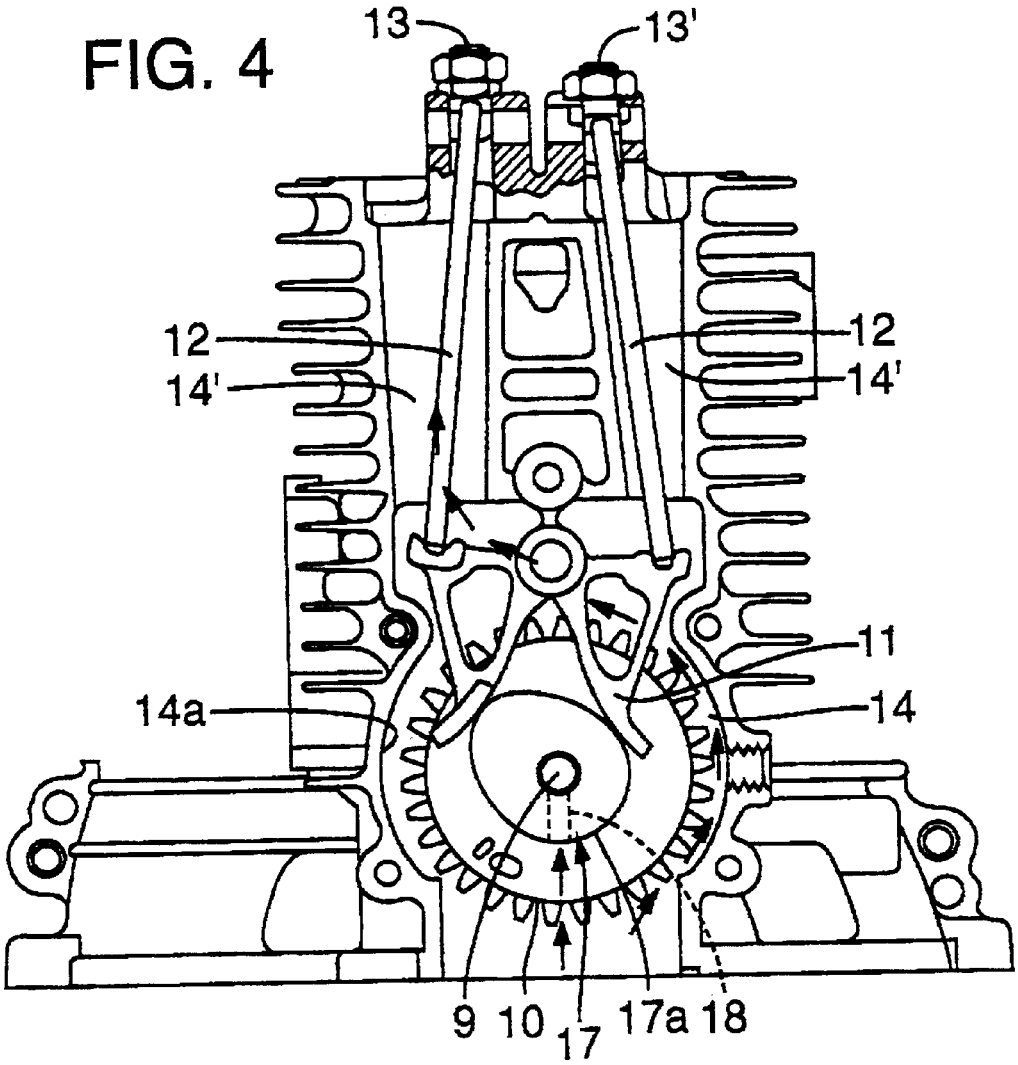

Appreciation for the flow path of the fuel from the check valve 6 will be further appreciated with reference also to FIGS. 3 and 4. The passage through check valve 6 first leads to the periphery of a timing gear 8 mounted and rotatable with the crank shaft 7. The flow of fuel is directed around the timing gear 8 as indicated by arrows. Timing gear 8 is inter-engaged with and produces rotation of cam gear 10 which rotates around cam gear shaft 9.

A cam 17 rotatable with cam gear 10 produces actuation of rocker arms 13 and 13' via actuation of cam lifters 11 connected to lift arms 12 which are connected to rocker arms 13, 13'. (See FIG. 4). As the cam gear 10 rotates (see the dash line arrow of FIG. 3), the flow of fuel is directed along the upward direction of rotation of cam gear 10 and into the cavity housing one or both push rods 12 as can be seen in either of FIGS. 3 and 4. Whereas the flow of the fuel can travel along either or both push rods 12, the circumferential flow dictated by cam 10 directs the fuel flow largely into the path surrounding the rod for rocker arm 13 as indicated by the arrows. It is considered feasible to design the positioning of the rods 12 whereby fuel flow is effectively limited to flow along that push rod. In either event the guide way along the push rod or rods 12 is restricted to a size that will closely confine the rods and thereby minimize the pathway 14.

Fuel flows upwardly into the area of the rocker arms 13, 13' and into passage 15 that leads to valve 16. The chamber 14" whereat the rocker arms 13, 13' reside are formed by cover 37 into a tight enclosure that is differentiated from prior enclosures indicated by dash lines 37*a*.

From the above it will be noted that the flow path can be separated into three components. A first component 14 extends from the check valve 6 up to and through the timing gear 8 and cam gear 10. A second component 14' extends along push rod 12 and into the overhead chamber housing the rocker arms 13, 13'. Movement through the chamber housing the rocker arms is the third component 14" which leads to the intake port 15 and intake valve 16 which is operated via the rocker arms 13, spring 24 and valve stem 23.

Other features to be noted include the spark plug 25 for igniting the fuel and the recoil starter 26 earlier discussed. Also shown in FIG. 1, is an exhaust valve 31, its valve stem 32 and actuating spring 33 which urges a counter movement to that of rocker arm 13'.

The objective of limiting the revolutions per minute (RPMs) of the engine is enabled by restriction of fuel intake port 15 to a size less than the air intake port 1*a* of the carburetor. This size differentiation is preferably established by first determining the fuel-air flow necessary for optimum engine speed of the engine under load and sizing the intake port 15 to enable that RPM while avoiding excessive running or increased RPMs when the engine is not under load, e.g. to an rpm of [12000 min −1] or less.

Whereas the above description is directed to a specific embodiment considered a preferred embodiment herein, those skilled in the art will understand and appreciate that numerous variations can be made to the structures above described without departing from the scope of the invention. The invention is accordingly determined by the claims appended hereto which are intended to have their usual meaning within the trade.

The invention claimed is:

1. A four-cycle engine comprising:

a fuel source providing a fuel and lubricant mixture and a carburetor mixing the fuel mixture with air and converting the mixture to vapor form;

a crank shaft chamber and a pathway from the carburetor to the crank shaft chamber, a reciprocating piston in the chamber and a combustion chamber overlying the piston, said reciprocating piston operable between the crank shaft chamber and combustion chamber to alternately increase and decrease the volumes in the crank case chamber and combustion chamber;

working components between the crank case chamber and combustion chamber which define a mixed fuel pathway from the crank case chamber to the combustion chamber and which pathway defines a volume;

said volume of the mixed fuel pathway between the crankcase chamber and the combustion chamber sized to be within a range of about 2 to 4 times the displacement of the piston.

2. A four-cycle engine as defined in claim 6 wherein said portion of the mixed fuel pathway includes a portion of the periphery of said cam gear, said portion of the periphery of the cam gear being rotatively moved in a direction toward the combustion chamber to facilitate movement of the fuel.

3. A four-cycle engine as defined in claim 1 wherein the engine includes a recoil starter for starting the engine.

4. A four-cycle engine as defined in claim 1 including a fuel intake port from the pathway to the combustion chamber and an air intake to the carburetor, the fuel intake port sized smaller than the air intake port for controlling the speed of the engine based on a desired speed when the engine is in a working mode.

5. A four-cycle engine comprising:

a fuel source providing a fuel and lubricant mixture and a carburetor mixing the fuel mixture with air and converting the mixture to vapor form;

a crank shaft chamber and a pathway from the carburetor to the crank shaft chamber, a reciprocating piston in the chamber and a combustion chamber overlying the piston, said reciprocating piston operable between the crank shaft chamber and combustion chamber to alternately increase and decrease the volume in the crank case chamber and combustion chamber;

working components between the crank case chamber and combustion chamber including a timing gear, a cam gear, an intake valve and valve actuating mechanism all interconnected and defining a mixed fuel pathway from crank case chamber to the combustion chamber; and said volume of the mixed fuel pathway between the crank case chamber and the combustion chamber sized to be within a range of about two to four times the displacement of the piston.

* * * * *

UNITED STATES PATENT AND TRADEMARK OFFICE

CERTIFICATE OF CORRECTION

PATENT NO. : 6,830,030 B2
DATED : December 14, 2004
INVENTOR(S) : Imafuku et al.

It is certified that error appears in the above-identified patent and that said Letters Patent is hereby corrected as shown below:

Column 4,
Line 37, "an air intake to the carburetor," should read -- an air intake port to the carburetor --

Signed and Sealed this

Fifth Day of July, 2005

JON W. DUDAS
*Director of the United States Patent and Trademark Office*